US007520493B1

(12) United States Patent
Haldane

(10) Patent No.: US 7,520,493 B1
(45) Date of Patent: Apr. 21, 2009

(54) FLOATING DIFFUSED AIR AERATOR

(76) Inventor: William J. Haldane, 270 Floss Flat Rd., Ste E, Belgrade, MT (US) 59714

( * ) Notice: Subject to any disclaimer, the term of this patent is extended or adjusted under 35 U.S.C. 154(b) by 0 days.

(21) Appl. No.: 10/967,554

(22) Filed: Oct. 18, 2004

Related U.S. Application Data

(60) Provisional application No. 60/512,309, filed on Oct. 18, 2003.

(51) Int. Cl.
*B01F 3/04* (2006.01)

(52) U.S. Cl. ..... 261/120; 261/122.1; 261/123; 261/DIG. 70; 210/242.2

(58) Field of Classification Search ..... 261/120, 261/121.1, 122.1, 122.2, 123, 124, 126, DIG. 70; 210/242.2
See application file for complete search history.

(56) References Cited

U.S. PATENT DOCUMENTS

| | | | | | |
|---|---|---|---|---|---|
| 3,193,260 | A | * | 7/1965 | Lamb | 261/64.1 |
| 3,462,132 | A | * | 8/1969 | Kaelin | 261/87 |
| 3,548,770 | A | * | 12/1970 | Boutros | 114/265 |
| 4,030,859 | A | | 6/1977 | Henegar | |
| 4,179,243 | A | | 12/1979 | Aide | |
| 4,448,689 | A | * | 5/1984 | von Nordenskjold | 210/521 |
| 4,690,756 | A | * | 9/1987 | Van Ry | 210/221.2 |
| 4,707,308 | A | * | 11/1987 | Ryall | 261/77 |
| 5,122,266 | A | * | 6/1992 | Kent | 210/150 |
| 5,549,828 | A | * | 8/1996 | Ehrlich | 210/602 |
| 5,565,096 | A | * | 10/1996 | Phelan | 210/150 |
| 5,595,691 | A | * | 1/1997 | Hsu | 261/120 |
| 6,432,302 | B1 | | 8/2002 | Obritsch | |
| 6,439,853 | B2 | | 8/2002 | Tormaschy | |
| 6,478,964 | B1 | * | 11/2002 | Redmon | 210/620 |
| 7,121,536 | B2 | | 10/2006 | Ruzicka et al. | |
| 2003/0127754 | A1 | | 7/2003 | Ruzicka | |

FOREIGN PATENT DOCUMENTS

| | | |
|---|---|---|
| JP | 2-251213 | * 10/1990 |

* cited by examiner

*Primary Examiner*—Scott Bushey
(74) *Attorney, Agent, or Firm*—Sarah J. Rhoades

(57) ABSTRACT

An aerator for mechanically inducing near laminar flow and controlled turbulence in a liquid waste treatment lagoon or pond. A blower, blower mount platform, diffuser modules, aeration manifold, aeration chamber, an adjustable, telescoping aeration chamber extension, baffles, and buoyancy apparatuses attach to a frame. The diffusers are located beneath the surface of the body of liquid at a predetermined, fixed depth. The blower supplies air to the diffusers and liquid-bubble mixture is released into an aeration chamber where artificial aeration is maximized. The mixture then rises through the aeration chamber. Bubble dissipation and flow conditioning baffles force bubbles to coalesce and vertically dissipate into the atmosphere. The liquid flows over the top of the baffles and a flow manipulation rim to radiate outward and parallel to the pond surface with minimum turbulence at an optimum flow discharge rate. The aerator provides optimized oxygen transfer at low energy costs.

20 Claims, 4 Drawing Sheets

PLAN VIEW

ELEVATION VIEW

FLOATING DIFFUSED AIR AERATOR

CROSS REFERENCE TO RELATED APPLICATION

This patent application claims priority under 35 U.S.C. § 119(e) to U.S. Patent Application Ser. No. 60/512,309, entitled "Floating Diffused Air Device", and filed on Oct. 18, 2003. The entire disclosure of that provisional patent application is hereby incorporated by reference.

FIELD OF THE INVENTION

The present invention generally relates to an aerator designed to affect a body of liquid, using diffused aeration technology applied from an isolated apparatus movably-supported by buoyancy apparatuses. The aerator according to the present invention is contemplated to be used in any of a variety of operations including personal, public, industrial, agricultural or aquacultural. Said body of liquid may comprise waste water, a pond, a lagoon, a basin, a lake, a stream or a similar body of liquid.

BACKGROUND OF RELATED ART

It is well established that oxygen and circulation are among the key components of any healthy, water-based ecosystem. Plant communities, algae, aerobic, facultative, and anaerobic bacteria provide a benefit to a body of liquid such as a waste water system because they carry on life processes which digest much of the bio-waste polluting these bodies, thus making the facilities more pleasing both in aroma and aesthetics. Many of these living organisms, such as aerobic bacteria, require oxygen to survive, but are immobile. Therefore, aerobic bacteria flourish, as do other organisms with which they interact, when a body of waste water or liquid is circulated. The displacement of these organisms brings them into contact with the nutrients upon which they survive. Because the movement can allow one organism in an ecosystem to interact and influence other organisms, the system is made more complete. Plainly, the interactions of these organisms vary depending upon biological, chemical and physical dynamics of the body of liquid or waste water. This is why engineers in the field have attempted to manipulate these dynamics in order to accomplish a more balanced ecosystem.

It has been established that adding artificial aeration to natural, as well as manmade ponds and lagoons, can greatly increase the health of the ponds. Artificial aeration involves injecting oxygen-containing gas into the depths of a body of water or liquid. The exposure of the liquid to free oxygen allows a system to increase its dissolved oxygen levels and thus, the health of the system. Pumping great quantities of oxygen-containing gas to the depths of a body of liquid requires great energy, and thus monetary expenditures. A plentiful source of oxygen is the atmosphere along the surface of the body of liquid. Because oxygen is naturally transferred to liquid during contact with the atmosphere, the attention of engineers in the field has turned to bringing greater volumes of liquid into contact with that readily available oxygen source.

Many attempts have been made to increase oxygen transfer rates into bodies of water. Accepted conventional methods include: splash-type units which pump large volumes of water discharged in small droplets (10 mm diameter); aspirator units which draw atmospheric air into a propeller and force air bubbles into the water; and, compressor devices which release air from their fixed location at the bottom of the pond. All of these devices are accepted methods of oxygen transfer, and all have inherent disadvantages, including high energy costs, high maintenance costs, inconsistent oxygen transfer rates and turbulent discharges which result in flow interference and small zones of influence.

It has been known for some years that water could obtain a near frictionless or non-turbulent flow at its surface if the correct energy at the correct angle is applied. As the law of inertia would dictate, this flow is interrupted when an outside force acts upon the water molecules. The frictionless flow occurs over the surface of a pond or lake and is commonly known as laminar flow. Laminar flow in this context, is typically interrupted by excess turbulence or waves generated by an aerator device or by the shore embankment where the molecules are turned back. This phenomenon is of particular importance with respect to achieving optimal flow and achieving a much greater zone of influence of the mixing, circulation and distribution of dissolved oxygen throughout the pond. The induction of laminar flow exposes greater volumes of water to the atmosphere. Since the atmosphere is the most readily available source of oxygen in most bodies of liquid, optimal levels of dissolved oxygen transfer may be obtained by the inducement of laminar flow.

The waste water treatment industry is continually expanding to meet the demands of population growth. As infrastructure demands increase, existing facilities must be upgraded and/or new facilities built. Effluent (facility discharge) quality requirements are becoming more restrictive, requiring more efficient technologies for successful operation. The continually increasing cost of power puts new pressure on industry to find more efficient treatment processes and equipment.

Past developments in the art have attempted to circulate waste water but have done so at high energy costs. Other devices, more recently introduced have sought to lower energy costs but have not been successful because they cannot provide oxygen transfer ratings accepted by industry and government. No device to date has successfully circulated liquid in a non-turbulent manner in order to maximize flow and maximize oxygen transfer.

Relatively recent developments in the area have attempted to utilize natural re-aeration processes by pumping water from near the bottom of the lagoon and discharging that water onto the surface. (See Ruzicka et al U.S. Pat. No. 7,121,536 B2.) These systems use less energy than prior treatment systems. As mentioned above, the disadvantage of these systems is a lack of industry-accepted, measured oxygen transfer rates, and their restriction to bodies of liquid with low waste loads. Quantifiable oxygen transfer measurements are required to meet industry standards and governmental mandates. In addition, natural reaeration cannot serve as a primary manner of predictably treating waste water because anomalies in waste can inhibit natural reaeration (e.g. oil slicks caused by petroleum or vegetable oils, and ice in cold winter climates).

More than 80% of the aeration systems utilized in mechanical treatment plants in the USA are diffused air systems, while less than 20% of aerated-lagoon systems use diffused air as their oxygen source. None of the aerated lagoon systems use a low pressure, air-lift pump assisted method of aeration with radially divergent discharge.

SUMMARY OF THE INVENTION

The present invention seeks to provide an aerated lagoon system using a reduced or low pressure, air-lift pump assisted method of aeration with radially divergent discharge. The present invention provides a new, useful and nonobvious means to mechanically provide oxygen to and circulate a body of liquid. The present invention mechanically provides 100% of the oxygen requirement for various waste load demands, and is thus not dependent on natural reaeration technology. If, however, a lagoon is benefitting from natural aeration, then the present invention's variable speed blower drive may be adjusted to conserve energy inputs. These and other features of the present invention allow it to optimize the performance of a body of liquid such as a waste water lagoon or pond.

The present invention comprises an aerator having a variable speed blower, an aeration manifold with at least one diffuser, an aeration chamber with a sub-diffuser adjustable extension, a bubble dissipation and flow conditioning baffle and a flow manipulation rim. Each of these components is mounted upon a frame member whereby the diffusers are housed within the aeration chamber which terminates in the bubble dissipation and flow conditioning baffles. The aeration chamber may be extended below the diffusers by an adjustable extension which telescopes to affect a greater sludge depth. The diffusers do not move as part of the telescoping action. Only the chamber portion below the diffusers extends downward. The diffusers produce a uniform displacement of air resulting in a consistent flow rate and therefore optimum bubble contact and induced flow upward through the aeration chamber. The baffles near the top of the aeration chamber converge before sloping to a flow manipulation rim. The converging baffles allow bubbles to coalesce and vertically dissipate before the liquid spills over the baffles and changes direction from vertical to horizontal. A controlled turbulence is created by the induced flow past the flow manipulation rim. The entire frame and all the components thereon are suspended in the liquid by at least one float. According to the preferred embodiment of the present invention, the aeration chamber is shaped in the form of a rectangular tube, or rectangular prism with four vertical walls and an opening below the diffusers and an opening atop the prism which terminates at the converging baffles. The lower opening further attaches the adjustable extension. The rectangular shape at the base of the tube accommodates the maximum number of diffusers for maximum oxygen transfer. This preferred embodiment requires four buoyancy devices affixed at each corner of the frame member in a manner which allows depth adjustment.

Various refinements exist in the features noted in relation to the present invention. Further features may also be incorporated in the present invention as well. These refinements and additional features may exist individually or in any combination. In the present invention, a control panel with a variable speed control of the blower motor allows energy output to be adapted to the conditions taking into consideration the existing level of active, natural re-aeration.

By utilizing diffuser modules to inject bubbles as an oxygen source, an aeration chamber to allow the bubbles to accelerate and coalesce, a unique flow conditioning baffle system to vertically release bubbles and condition the flow to radiate outwardly from the unit with minimum turbulence, and variable speed blower to use only the horsepower required by the aerator, the present invention achieves a more desirable processing of waste water. Near laminar flow is created by obtaining a near frictionless or controlled turbulent flow near a liquid surface. With the correct rate of speed from the flow manipulation rim, a two to three inch continuous layer of liquid flow is created over the surface of a pond or lake. This phenomenon is of particular importance to the present invention because optimal flow achievement allows a much greater zone of influence of the mixing, circulation and distribution of dissolved oxygen throughout the pond and exposes greater volumes of liquid to the atmosphere, the most readily available source of oxygen in most bodies of liquid. When prolonged, near laminar flow is achieved, the maximum amount of liquid molecules are exposed to the atmosphere, thus, increasing supplemental dissolved oxygen by natural reaeration and reducing demand of oxygen transfer from the aerator. In ideal conditions, the present invention may induce flow distinctly the opposite of turbulent and approaching pure laminar flow characteristics. The simplicity of the design and components make the floating diffused air aerator more universally usable and more versatile in operation than known devices of its kind.

As another element of the present invention, custom diffuser modules allow for selections in diffuser style between fine, medium and course bubble. The custom design features allow for a zone of influence from one to five acres. In the preferred embodiment, the simple frame member and aeration chamber are desirably constructed of stainless steel. Other variations may be possible.

Another feature of the present invention provides variable speed control of the aeration blower so that only the air required to satisfy the oxygen demand of the lagoon is supplied. When the speed of the aeration blower is reduced, the horsepower expended is also reduced, which reduces the overall energy costs.

The present invention generally comprises a frame member with a mount above the liquid level which may accommodate an aeration blower. The aeration blower may also be remotely located. The frame member also supports the aeration manifold with mounting supports. The aeration manifold, consisting of an aeration header and aeration lateral which feed the manufacturer's standard diffuser modules that are engaged with the aeration manifold by mounting studs or threaded insert adapters. The frame member supports the aeration chamber, adjustable extension, bubble dissipation and flow conditioning baffles, and flow manipulation rim.

The aerator floats in the pond with the aid of a buoyant apparatus, complete with adjustable flow rods to provide depth adjustment for the aerator according to the present invention. Factors considered when determining the fixed depth of submergence for the present invention include oxygen demand, waste load, and pond depth. The diffuser modules are housed within the aeration chamber at fixed, but selectable level. Air is supplied from the blower, mounted above the liquid level or on the shore, to the submerged diffuser modules where the bubbles are released. Typical bubble styles utilized in waste water applications are coarse bubble (10 mm and larger), medium bubble (4 mm to 6 mm), and fine bubble (2 mm and smaller). For this embodiment, the optimum bubble style is medium.

As the bubbles are released they begin to rise. The rising bubbles mix with the liquid. The aerated mixture continues to rise to the surface. As the mixture rises, it flows through the aeration chamber toward the converging bubble dissipation and flow conditioning baffles. As the bubbles rise through this chamber of the aerator they accelerate. As they converge under the bubble dissipation and flow conditioning baffles, they coalesce into larger bubbles. The bubbles dissipate vertically into the atmosphere while the liquid flows over the top of the baffles and across the flow manipulation rim. The discharged liquid molecules exit the aerator in a horizontal plane with enough momentum to carry them to the shore radially outward from the aerator in a horizontal flow direction with minimal turbulence and with minimal entrained bubbles. Once the flow reaches the shore, it may be turned back or downward in the pond thereby enhancing pond mixing.

According to the present invention, the bubble dissipation and flow conditioning baffles may be approximately three inches wide with a thickness of about one-eighth inch (⅛"). The preferred embodiment calls for the baffles to be nine inches wide at an angle of approximately sixteen degrees (16°). This embodiment calls for the flow manipulation rim to be three inches wide. It is necessary to vertically position the aerator so that the flow conditioning baffles allow the discharged liquid to leave the aerator at a rate of approximately two feet per second with as few bubbles as possible. This rate of discharge coupled with minimal entrained bubbles allows the liquid to exit the rim with minimal resistance and therefore minimal turbulence. Other orientations may be possible. The aerator may be adapted in light of the body of liquid at issue.

According to the preferred embodiment of the present invention, the frame member is in the form of a rectangular prism to which all the invention components are secured. The buoyancy apparatuses are secured at the corners in this embodiment in order not to interfere with the radial flow generated. An alternative embodiment of the present invention, termed the conical embodiment, discussed more below, utilizes a flow directional cone, also called the conical conditioning baffle. In this embodiment, the aeration chamber is shaped in the form of a cylinder. The flow directional cone replaces the converging rectangular prism formation of the preferred embodiment's baffles and retains the benefits of the aeration chamber, baffling mechanism, and flow manipulation rim. In the conical embodiment, the flow directional cone acts as the bubble dissipation and flow conditioning baffle.

As another feature of its adaptability, the conical embodiment of the present invention also features an adjustable extension of the aeration chamber called the sub-diffuser adjustable extension, which draws liquid from selectable depths near the lagoon bottom. Thus, the present invention affects a greater sludge depth without having to increase horsepower of the blower because the diffusers do not change depth.

Another aspect of the conical embodiment of the present invention generally comprises a frame member with a mount above the water level, which may accommodate an aeration blower. The frame member also supports the air manifold which in one standard manufacturer's provision incorporates diffusers with mounting supports. In this variation of the air manifold, the manifold consists of an aeration header and aeration lateral which feed the diffuser module, and are engaged with the aeration manifold by a mounting stud. As described above, the diffuser modules are located within the aeration chamber. Air is supplied from the blower, mounted on the frame above the liquid level, to the submerged diffuser modules where the bubbles are released into the chamber. The unit is supported by a buoyancy apparatus, complete with adjustable flow rods to provide depth adjustment for the aerator according to the present invention. The diffuser modules are located within the aeration chamber at fixed, but selectable level. Factors considered when determining the fixed depth of submergence for the present invention include oxygen demand, waste loading, and pond depth.

As the bubbles are released they begin to rise through the cylindrical aeration chamber of the conical embodiment. The rising bubbles mix with the liquid. The aerated mixture continues to rise to the surface. As the mixture rises, it flows through the aeration chamber and over the conical embodiment's bubble dissipation and flow conditioning baffles. As the bubbles flow through this chamber of the aerator they accelerate and coalesce into larger bubbles. The baffles aid the vertical bubble dissipation into the atmosphere. The treated liquid, flows over the top of the baffles and across the flow manipulation rim. The discharged water molecules exit the aerator near laminar flow rates with enough momentum to carry them to the shore.

Various refinements exist in the features noted in relation to this conical embodiment aspect of the present invention. Further features may also be incorporated into this aspect of the present invention as well. These refinements and additional features may exist individually or in any combination. Even in this embodiment it is preferred to position the aerator so that the flow conditioning baffles allow the discharged liquid to leave the aerator at a rate of approximately two feet per second. This rate of discharge allows the flow to exit the rim with minimal resistance and therefore minimal turbulence. The aerator may be adapted considering the critical variables of the body of liquid at issue.

As an additional key feature of this conical embodiment aspect, the flow conditioning process is achieved by a flow directional cone. Once again, the sub-diffuser telescoping chamber will allow liquid to be drawn from selectable depths near the lagoon bottom and treated.

Another aspect of the present invention is embodied by a method for aerating a body of liquid. An oxygen-containing gas is injected into the liquid body in the form of bubbles so as to create an oxygen-rich mixture of liquid and gas. The oxygen rich mixture is then forced through an aeration chamber.

As the bubbles rise through this chamber of the aerator they accelerate. The bubbles converge under the bubble dissipation and flow conditioning baffles. The convergence causes the bubbles to coalesce into larger bubbles. The bubbles separate from the liquid by dissipating vertically into the atmosphere. The liquid then flows over the top of the baffles and across the flow manipulation rim. The discharged liquid molecules exit the aerator in a horizontal plane with enough momentum to carry them to the shore radially outward from the aerator in a horizontal flow direction with minimal turbulence and with minimal entrained bubbles. Desirably, the flow rate is manipulated by the structure in order to influence flow such that the liquid exits at a rate of two feet per second, thus optimizing laminar flow.

Various refinements exist in the features noted in relation to this method aspect of the present invention. Further features may also be incorporated in the method of the present invention as well. These refinements and additional features may exist individually or in any combination. The injection of gas may be performed by a plurality of diffusers, which will generate bubbles in selectable styles. Although the bubbles may be propelled toward the surface at first, this method requires that the bubbles are forced to converge, coalesce, and dissipate just prior to the treated liquid returning to the surrounding body of liquid. Upon exiting the baffles and the flow manipulation rim, positioned approximately parallel with the surface of the body of liquid, the method of the present invention requires that the oxygen rich mixture be forced from the aeration chamber to the outer body of fluid in a radially outward direction from the aeration chamber. Because the flow manipulation rim is positioned just at or below the surface of the pond, the radial flow will continue to the shore where it may be turned back or downward in the pond. The present invention creates optimal movement in a body of liquid. Movement is known to optimize natural reaeration phenomena.

The apparatus discussed above may be utilized in the execution of the method described.

The foregoing has outlined, in general, the physical aspects of the invention and is to serve as an aid to better understanding the more complete detailed description which follows. In reference to such, the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section which follows.

DETAILED DESCRIPTION OF THE INVENTION

Figure 1:
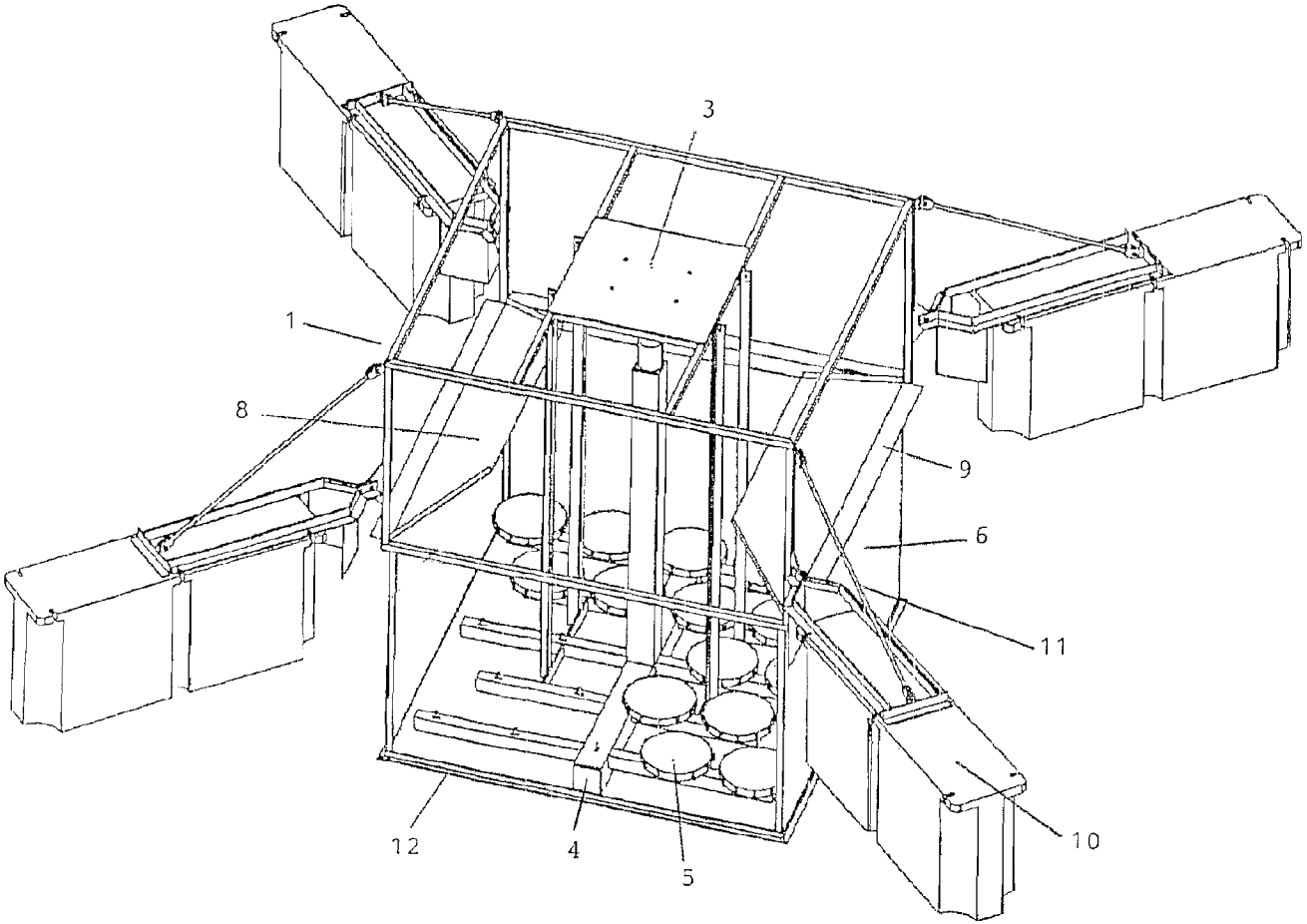
FIG. 1. is a partially cut-away, isometric view of the preferred embodiment of the floating diffused air aerator, rectangular embodiment, showing the orientation of its major components and the location of the buoyancy apparatuses in relation to the diffusers and frame of the aerator.

The primary objective of the present invention is to provide an adaptable aeration device for oxygenating and circulating a liquid such as waste water in ponds, lagoons and similar bodies of liquid using diffused aeration technology.

It is an additional objective of the floating diffused air aerator to provide a method to sufficiently increase the dissolved oxygen content of waste liquid by introducing oxygen-containing gas into the body of fluid. In a further objective for the aerator, the aerator provides a method to produce a low turbulence, near laminar flow projecting radially outward from the aerator. Simply put, the present invention seeks to efficiently get bubbles into a body of liquid and then get them out in order to induce optimum flow. In another objective, the aerator seeks to provide a method to take advantage of the natural re-aeration processes which occur due to the increased circulation. In a further objective, the aerator seeks to provide a method to allow bodies of liquid to optimize the biological processes, categorized as aerobic, facultative, and anaerobic. It is a further objective of the present invention to be adaptable so that when the mentioned natural processes are thriving, outside energy input may be adjusted by reducing the blower speed in order to reduce energy costs. The present invention seeks to provide municipalities with measurable energy savings in order to gain subsidies from energy companies and acceptance from state agencies.

It is a further objective of the present invention to combine these characteristics in a compact, floating, portable aerator that can be placed in a desired location and left to circulate waste water or other liquid from a lower depth to the surface. As a final objective, the floating diffused air aerator seeks to maintain a simple design that has low maintenance costs and requirements.

These objectives are accomplished by the present invention by utilizing variation capabilities for the flow adjustment rod, diffuser module depth and style, blower speed and depth of inlet of the aeration chamber. These objectives are accomplished by using at least one buoyancy apparatus to locate the floating diffused air aerator, in either the conical or rectangular embodiment, in a treatment area where its variable speed blower may discharge oxygen-containing gas. The aerator may be attached to posts located on the shore with stainless steel cables. A power source is provided from the shore or the entire aeration blower may be located in a remote location. The blower is intended to be equipped with a variable frequency drive which allows the aeration blower to be slowed in order to save on energy costs, if variations in waste load occur or when the natural re-aeration processes are present.

The present invention fills the need in the industry by providing an aerator with lower energy requirements, yet guaranteeing a predictable result as a user or municipality seeks to comply with regulations and mandates. These features have allowed municipalities to gain payment assistance from energy companies and has earned the present aerator acceptance with western states. This method or aerator is designed to gently mix waste water or liquid from bottom-to-top with a minimum amount of energy and deliver that waste water or liquid to the surface of the liquid to contact the atmosphere, a major oxygen source, in a low turbulence, near laminar flow manner which will maximize natural circulation and overall absorption from the atmosphere. The present invention provides a low-pressure, air-lift pump-assisted method of aeration with a radially divergent discharge. The results produced by the present invention are quantifiable and have been accepted by western states.

The floating diffused air aerator accomplishes these goals by providing optimum oxygen transfer through the introduction of artificial air into the waste liquid by using selectable styles of diffusers, running at variable rates. In addition, an air-lift pumping effect moves a large volume of liquid through the unit. In one embodiment, the air-lift pumping effect displaces 15 to 20 gallons per cubic foot per minute. Other variations may be possible. This movement is slowed and controlled by the bubble dissipation and flow conditioning baffles so that liquid flows over the flow manipulation rim at a controlled rate. In one embodiment, the discharge rate is contemplated to be two (2) feet per second so that the displaced liquid exits the aerator with minimal turbulence and near laminar flow. Other variations may be possible. This low turbulence flow exits from all sides of the unit in a radial manner and continues to shore. It is contemplated that the aerator described in the present invention will mechanically influence mixing in a pond as large as five acres. Providing multiple mechanical units will allow larger pond applications and/or treatment of heavy waste loads. This large zone of flow influence allows a greater volume or area of liquid to be exposed to the atmosphere. Since the atmosphere is the most readily available source of oxygen, the extra exposure caused by the aerator according to the present invention is able to take advantage of the added benefits of natural re-aeration. If natural reaeration occurs then the present invention can compensate for it by use of the variable speed motor for the blower.

The aerator incorporates novel features not offered by the prior art and does so in a new and useful manner. The result is a new pond aeration device, which is not apparent, obvious, or suggested, either directly or indirectly by any of the related art.

DESCRIPTION OF EMBODIMENTS

The present invention will now be described in relation to the accompanying drawings which at least assist in illustrating its various pertinent features. Referring now to the drawings and more specifically to FIG. 1, which demonstrate the floating diffused air aerator in its rectangular prism embodiment. The rectangular prism frame member 1, provides the support to which the other components of the present invention are attached. The frame member 1 is desirably constructed of stainless steel.

The aeration blower 2 (not shown in this figure, but see FIG. 5) is mounted upon the blower mount platform 3 at the upper most end of the frame member 1. The aeration blower 2 transfers an oxygen-containing gas into the aeration manifold 4. This gas is released into the aeration chamber 6 in the form of bubbles formed by the diffuser modules 5 of selectable style and number. Diffusers form a curtain of air which accelerates through the aeration chamber 6 toward the liquid surface. The bubbles travel to the top of the aeration chamber 6 to the bubble dissipation and flow conditioning baffles 8 which cause the bubbles to coalesce into larger bubbles. The bubbles discharge vertically into the atmosphere leaving the liquid behind. The liquid then falls over the baffles and then the flow manipulation rim 9 to return to the surrounding liquid.

It is necessary to position the aerator so that the bubble dissipation and flow conditioning baffles 8 allow the discharged liquid to achieve a discharge velocity of approximately two feet per second as it exits the flow manipulation rim 9. This rate of discharge caused by the slope and submergence of the baffles 8 allows the flow to exit the flow manipulation rim 9 with minimal resistance and therefore minimal turbulence. The aerator may be adapted as required by the body of liquid being aerated.

A buoyancy apparatus 10 is provided from which the aerator may suspend in a body of liquid. The buoyancy apparatus 10 is attached to the frame member 1 of the aerator with flow adjustable rods 11.

Multiple variation capabilities of the present invention allow for a custom selection of the respective components in order to optimize the discharge rate and influence an area of liquid between one and five acres in size. If pond conditions are conducive, one unit will treat a five acre pond. However, pond variables such as depth and loading will dictate whether additional units are required to affect even a five acre pond properly. As described herein, the present invention also allows for custom diffuser module 5 selections between fine, medium and course bubble. In addition to diffuser module 5 style, ready adaption capabilities are present at the flow adjustment rods 11, the sub-diffuser adjustable extension 12, and the aeration blower 2 horse power and speed. The sub-diffuser adjustable extension allows the aeration chamber to be extended below the diffusers. The adjustable extension telescopes to affect a greater sludge depth. The diffusers do not move as part of the telescoping action, only the chamber portion below the diffusers. The sub-diffuser adjustable extension 12 will be desirably telescoped after the aerator begins successfully treating the body of water and removing sludge from the bottom of the body of liquid. The adjustment of the aeration chamber permits the aerator to remain effective by reaching sludge near the bottom of the liquid.

Figure 2:
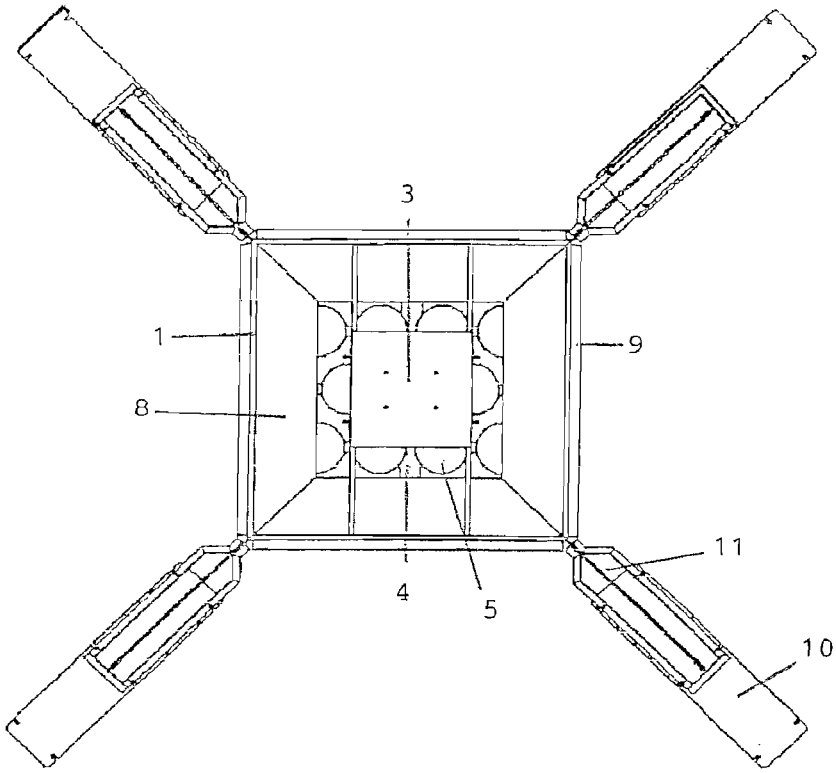
FIG. 2. is a plan view of the floating diffused air aerator of FIG. 1, showing the orientation of the diffuser module and the aeration blower mount in relation to the buoyancy apparatuses.

FIG. 2 is a plan view of the floating diffused air aerator of FIG. 1, showing the orientation of the diffuser module 5 and the aeration blower mount 3 in relation to the buoyancy apparatus 10. This view of the aerator is a poignant demonstration of the converging bubble dissipation and flow conditioning baffles 8 which allow the bubbles generated to coalesce and then dissipate vertically into the atmosphere and the liquid exits the aerator horizontally over the flow manipulation rim 9.

Figure 3:
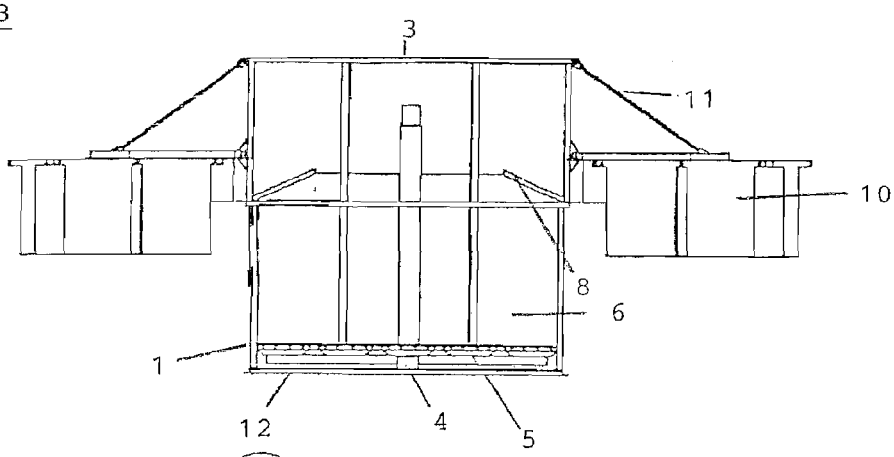
FIG. 3. is a partially cut-away elevation view of the floating diffused air aerator of FIG. 1, showing the rectangular embodiment and particularly illustrating the aeration chamber respective to the bubble dissipation and flow conditioning baffles.

FIG. 3 is an elevation view of the floating diffused air aerator. The side wall of the aeration chamber is transparent in this drawing in order to demonstrate the location of the components further illustrated in FIG. 4. The components discussed in FIG. 1 are again illustrated in this drawing. Note particularly, the flow adjustment rods 11 shown in this view which extend outward to attach to the plurality of buoyancy apparatuses 10. These buoyancy apparatuses 10 are positioned at the outer edge of frame member 1 which provides for more stability when the aerator is placed in a pond, lagoon or other body of waste water or liquid. The position of the buoyancy apparatuses 10 also provide minimum interference with the liquid exiting the aerator in a radially outward direction. In the rectangular embodiment, the buoyancy apparatuses 10 are placed at or near the four corners. The buoyancy apparatuses 10 and flow adjustment rods 11 serve to keep the present invention and all of its components properly oriented in the liquid surface level.

An additional member, the aeration manifold 4, is depicted in this illustration extending from near the blower mount platform 3 down to the diffuser modules 5.

Figure 4:
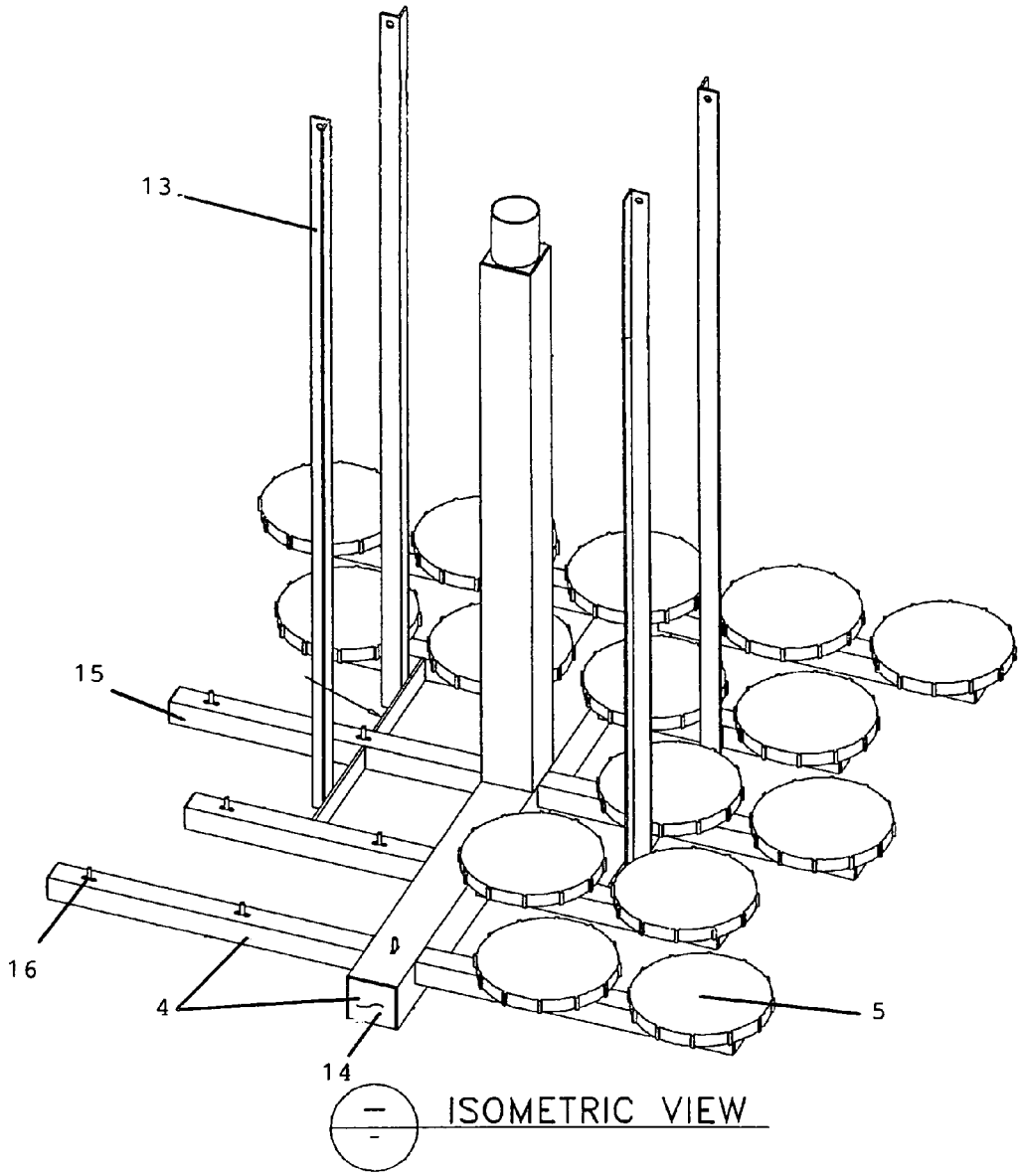
FIG. 4. is an isometric view of one manufacturer's standard diffuser module and aeration manifold.
Figure 5:
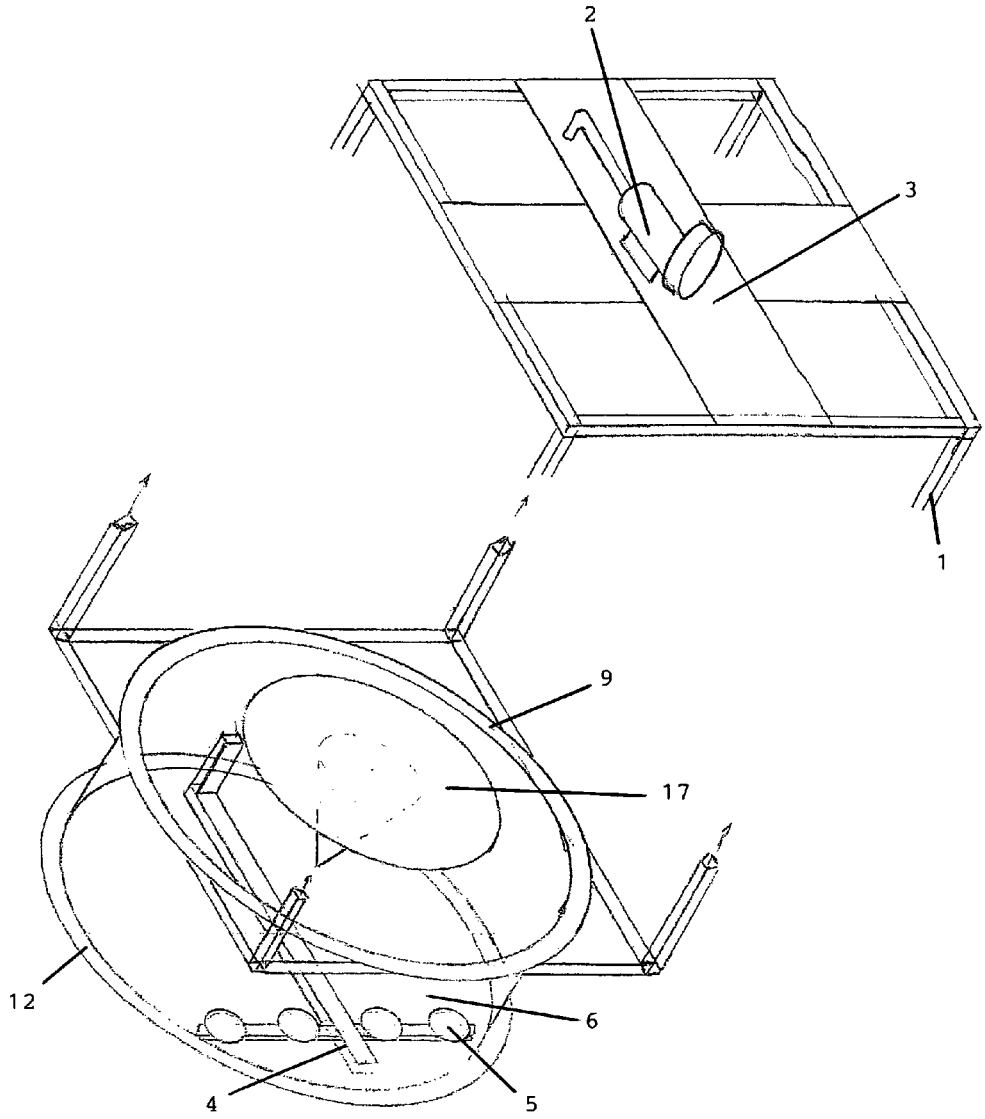
FIG. 5. is an exploded, isometric view of the diffuser module and aeration manifold according to one manufacturer's standard as it is used in relation to the aeration chamber for the conical embodiment of the present invention. The walls of the cylindrical aeration chamber are transparent here so that the diffuser module is visible.

FIG. 4 demonstrates an internal view of the aerator and particularly shows one manufacturer's standard variation of how the aeration manifold 4 is broken down in order to feed oxygen-containing gas to the diffuser modules 5. First, the drawing depicts how the aeration manifold 4 and diffuser modules 5 are secured to the frame member 1 by the mounting support(s) 13. This figure illustrates how the aeration manifold 4 is comprised of an aeration header 14 and aeration lateral 15. This illustration also shows one possibility for attaching the diffuser modules 5 to the aeration manifold 4, particularly with the diffuser mounting stud 16. An array of commercially available flexible membrane diffusers on twelve inch centers may be used to produce a solid curtain of air to rise vertically through the aeration chamber. A uniform pattern of flexible membrane diffusers mounted horizontally at a fixed level within the aeration chamber provide a total membrane surface area of at least fifty percent (50%) of the horizontal area of the aeration chamber. The aeration manifold will be sized to provide uniform air distribution through the diffuser modules 5 over an airflow range from two to ten cubic feet per minute per diffuser. This airflow range is determined by oxygen demand and is accomplished through the use of a variable frequency drive on the blower motor. Other variations are possible and are commercially available. FIG. 5 illustrates an exploded isometric view of another embodiment of the floating diffused air aerator, the conical embodiment. This embodiment utilizes a one-piece, solid flow directional cone as the conical conditioning baffle 17 in place of the aeration chamber and bubble dissipation and flow conditioning baffles 8. A cylindrical aeration chamber replaces the rectangular prism aeration chamber of the preferred embodiment. This conical embodiment allows for a smaller number of diffuser modules 5 to be used on the aeration manifold 4.

This figure also illustrates an internal view of the conical embodiment, less the aeration chamber and bubble dissipation and flow conditioning baffles 8 which have been replaced by the cone. Except for the buoyancy apparatus 10 and flow adjustment rods 11, all of the other components described in FIG. 1 are again located in this illustration. Although not shown, these components are required for operation of the conical embodiment of the present invention. Once again the frame member is desirably constructed of stainless steel.

It is further intended that any other embodiments of the present invention which result from any changes in application or method of use or operation, method of manufacture, shape, size, or material which are not specified within the detailed written description or illustrations contained herein are considered apparent or obvious to one skilled in the art and are within the scope of the present invention.

LEGEND OF NUMBERED COMPONENTS

1. Frame Member
2. Aeration Blower
3. Aeration Blower Mount Platform
4. Aeration manifold
5. Diffuser module
6. Aeration and Flow Chamber
7. Bubble Dissipation and Flow Conditioning Chamber
8. Flow Conditioning Baffle
9. Discharge Rim
10. Buoyancy Apparatus
11. Flow Adjustment Rod(s)
12. Adaptable Extension to Aeration Chamber
13. Mounting Supports
14. Aeration Header
15. Aeration Laterals
16. Diffuser Mounting Stud(s)
17. Conical Conditioning Baffle

I claim:

1. A diffused-air aerator for inducing flow in a liquid waste treatment lagoon or pond, comprising:

a variable speed blower to generate oxygen-containing gas;

a plurality of diffuser modules located below the surface of the liquid being aerated which diffuser modules receive the oxygen containing gas from the blower and release the oxygen-containing gas into the liquid in bubble formation;

an aeration manifold;

an aeration chamber which houses the diffuser modules;

wherein the aeration chamber has an adjustable extension below the diffuser modules;

the aeration chamber is capped with a bubble dissipation and flow conditioning baffle;

a flow manipulation rim at the nadir of the bubble dissipation and flow condition baffle forms an angle parallel with the surface of the body of liquid;

a stainless steel frame member upon which the blower, the diffuser module, the manifold, the aeration chamber, and the baffle are affixed;

at least one buoyancy apparatus secured to the frame member using at least one flow adjustment rod in a manner to submerge the aerator at a predetermined, fixed, selectable depth;

wherein said frame member further comprises a blower mount platform located upon the frame member such that the aeration blower may be secured above the surface of the liquid.

2. An aerator as claimed in claim 1, wherein the aeration chamber is generally shaped and configured in the form of a rectangular prism with vertical walls, an opening at the top, and an opening at the bottom.

3. An aerator as claimed in claim 1, wherein the aeration chamber is generally shaped and configured to form a cylindrical tube disposed below a flow directional cone.

4. A controlled turbulence, diffused-air aerator for inducing flow in a liquid waste treatment lagoon or pond, comprising:

an aeration blower to generate oxygen-containing gas;

at least one diffuser module located below the surface of the liquid being aerated which may receive the oxygen-containing gas from the aeration blower and then inject it into the body of liquid;

an aeration manifold comprising at least one pipe extending from the aeration blower to the diffuser module;

an aeration chamber vertically spaced from the diffuser module;

at least one bubble dissipation and flow conditioning baffle vertically disposed upon the aeration chamber;

a frame member upon which the blower, the diffuser module, the manifold, the chamber, and the baffle are affixed;

at least one buoyancy apparatus secured to the frame member in a manner to submerge the aerator at a predetermined, fixed depth;

the aeration chamber further comprising an adjustable extension below the diffuser modules in order to affect sludge depth at varying depths below the aerator.

5. An aerator as claimed in claim 4, wherein the aeration chamber is generally shaped and configured in the form of a rectangle with vertical walls, an opening at the top and an opening at the bottom.

6. An aerator as claimed in claim 4, wherein the aeration chamber is generally shaped and configured to form a cylindrical tube disposed below a flow direction cone.

7. An aerator, as claimed in claim 4, wherein:

said bubble dissipation and flow conditioning baffle(s) converge atop the aeration chamber.

8. An aerator, according to claim 4, wherein:

said aeration manifold comprises at least one aeration header.

9. An aerator, as claimed in claim 8, wherein:

said aeration header(s) extends from the aeration blower to the diffuser module via at least one aeration lateral.

10. An aerator, as claimed in claim 8, wherein:

said aeration header(s) further comprises a diffuser mounting stud with which the diffuser module(s) may engage.

11. An aerator, as claimed in claim 8, wherein:

said aeration lateral(s) further comprises a diffuser mounting stud with which the diffuser module(s) may engage.

12. An aerator, as claimed in claim 8, wherein:

said aeration header(s) further comprises an insert adaptor which may be engaged with the diffuser module.

13. An aerator, as claimed in claim 9, wherein:

said aeration lateral(s) further comprises an insert adaptor which may be engaged with the diffuser module(s).

14. An aerator, as claimed in claim 4, wherein:

said frame member comprises a blower mount platform located upon the frame member.

15. An aerator, according to claim 4, wherein:

said bubble dissipation and flow conditioning baffle(s) is located such that injected gaseous bubbles may be projected from the diffuser module upward through the aeration chamber to await a controlled discharge into the atmosphere as the liquid continues over the bubble dissipation and flow conditioning baffle(s) and the flow manipulation rim.

16. An aerator, according to claim 4, wherein:

said bubble dissipation and flow conditioning baffle(s) are at least 3 inches wide.

17. An aerator, as claimed in claim 4, wherein:

said aeration blower may be selected to operate at variable speeds.

18. An aerator, as claimed in claim 4, wherein:

said diffuser module may have styles varying from fine, to medium, to course as required by physical dynamics of the liquid being aerated.

19. An aerator, as claimed in claim 4, wherein:

said aerator utilizes a plurality of diffuser modules.

20. A controlled turbulence, diffused-air aerator for inducing flow in a liquid waste treatment lagoon or pond, comprising:

a variable speed blower to generate oxygen-containing gas;

a variable frequency drive mounted on the shore to take electrical power to the blower;

a plurality of diffuser modules located below the surface of the liquid being aerated which diffuser modules inject the oxygen-containing gas from the blower into the liquid in bubble formation, said diffuser modules having styles varying from fine, to medium, to course as required by physical dynamics of the liquid being aerated;

an aeration manifold comprising at least one pipe extending from the aeration blower to the diffuser module wherein said aeration manifold comprises at least one aeration header which extends from the aeration blower to the diffuser module via at least one aeration lateral, wherein said aeration header(s) further comprises an insert adaptor which may be engaged with the diffuser module, wherein said aeration lateral(s) further comprises an insert adaptor which may be engaged with the diffuser module(s);

an aeration chamber vertically spaced from the diffuser module wherein the aeration chamber is a rectangular prism with a converging opening vertically spaced from the diffuser modules;

said rectangular prism having a vertical wall between the body of liquid and the liquid being aerated in the surrounding liquid;

wherein the aeration chamber has an adjustable extension below the diffuser modules in order to affect sludge depth at varying depths below the aerator;

a bubble dissipation and flow conditioning baffle forms a converging constrictive area at the outer edge of the top of the aeration chamber, wherein said bubble dissipation and flow conditioning baffle(s) are nine inches wide, wherein said bubble dissipation and flow conditioning baffles terminate in a flow manipulation rim, wherein the flow manipulation rim forms an angle parallel with the surface of the body of liquid in order to direct the discharged aerated fluid radially outward from the aerator and induce flow in the liquid;

wherein said aeration chamber provides an area within which bubbles formed by the diffuser modules may rise and accelerate;

wherein the bubbles formed are forced to coalesce and form larger bubbles by the constricting bubble dissipation and flow conditioning baffles, which baffles allow controlled release of the bubbles vertically into the atmosphere and which baffles further provide an exit point for the liquid to return to the body of liquid with minimum turbulence and optimum flow discharge rate after flowing over the flow manipulation rim positioned approximately parallel with the surface of the body of liquid below the surface of the pond thus generating a radial flow that will continue to the shore where it may be turned back or downward in the pond;

a stainless steel frame member upon which the blower, the diffuser module, the manifold, the aeration chamber, and the baffle are affixed, four foam-filled buoyancy apparatuses secured to the corners of the frame member using four stainless steel flow adjustment rods in a manner to submerge the aerator at a predetermined, fixed, selectable depth;

wherein said frame member further comprises a blower mount platform located upon the frame member such that the aeration blower may be secured above the surface of the liquid.

* * * * *